US006029315A

United States Patent [19]

Flower

[11] Patent Number: 6,029,315

[45] Date of Patent: Feb. 29, 2000

[54] SCREWDRIVER HANDLE MECHANISM

[76] Inventor: Robert Flower, P.O. Box 2912, Hollywood, Calif. 90078

[21] Appl. No.: 09/003,548

[22] Filed: Jan. 6, 1998

[51] Int. Cl.[7] ..... B25B 15/04; B25B 23/16

[52] U.S. Cl. ..... 16/422; 81/177.1

[58] Field of Search ..... 81/177.1, 177.2, 81/177.85, 489; 16/110 R, 114 R, 422, 426, 436, 110.1; 292/288, 347, DIG. 2; 215/216–221, 230

[56] References Cited

U.S. PATENT DOCUMENTS

| | | | |
|---|---|---|---|
| 1,049,650 | 1/1913 | Benjamin | 81/177.1 |
| 3,556,571 | 1/1971 | Laub, Jr. | 292/DIG. 2 |
| 3,837,518 | 9/1974 | Gach | 215/219 |
| 4,093,008 | 6/1978 | Martin | 145/61 EA |
| 4,220,247 | 9/1980 | Kramer | 215/219 |
| 5,052,253 | 10/1991 | Lin | 81/489 |
| 5,431,075 | 7/1995 | Cruz et al. | 81/177.1 |
| 5,701,998 | 12/1997 | Perry et al. | 16/111 R |

FOREIGN PATENT DOCUMENTS

| | | | |
|---|---|---|---|
| 3309499 | 9/1984 | Germany | 81/489 |

*Primary Examiner*—Chuck Y. Mah
*Assistant Examiner*—Donald M. Gurley
*Attorney, Agent, or Firm*—Eugene Oak

[57] ABSTRACT

A handle intended to be used in conjunction with a conventional screwdriver that allows a user to operate on a screw without having to remove and reposition the screwdriver on the screw. The handle comprises a shaft having an elongated cavity disposed therein, wherein the handle of a conventional screwdriver is accommodated within the cavity in a lengthwise orientation. A spring attached to the end of the cavity is longitudinally disposed within the cavity, the spring having a rubber stopper disposed at its end opposite of the end of the cavity. When a screw is to be operated on, a downward normal force is applied to the screw in addition to the rotational force required to turn the screw. The downward force compresses the spring, and the rubber stopper contacts the top of the handle, thereby translating rotational motion of the shaft to the handle of the screwdriver, to the shaft of the screwdriver, and finally to the screw. When the shaft has been rotated to a point where the user is no longer able to rotate the shaft to produce adequate force to operate the screw, the user releases the downward normal force and rotates the shaft in the opposite direction. The force exerted by the spring alone is sufficient to prevent the tip of the screwdriver from being dislodged from its mating engagement with the screw.

4 Claims, 1 Drawing Sheet

SCREWDRIVER HANDLE MECHANISM

CROSS REFERENCE

The following utility patent application is for the invention that was disclosed in Disclosure Document No. 423,976 that was received in the USPTO mailroom on Sep. 10, 1997. The title of this invention in the Disclosure Document was "The Universal Screwdriver Handle".

BACKGROUND OF THE INVENTION

1. Field of the Invention

The present invention generally relates to tools and other devices generally used in the fields of construction and carpentry, and specifically to a screw driver handle to be used in conjunction with a conventional screwdriver.

2. Description of the Prior Art

Conventional screwdrivers are simple and sturdy in design, but require either that the user remove the wrench from the screw and reposition it on the screw to facilitate the rotation of the handle by the user, or that the user reposition his hand while being careful not to remove the head of the screwdriver from the screw. Not only does this make fastening a screw more time consuming and tedious, but the repeated repositioning of the screwdriver on the screw may cause unwanted stripping and/or wear on the screw.

The prior art in the field of screwdrivers teach several improvements and variations of screwdrivers and components used in conjunction with screwdrivers. However, the prior art does not teach a screwdriver handle as taught by the present invention.

Consequently, the primary object of the present invention is to provide a screwdriver handle that allows a user to operate on a screw without having to remove and reposition the screwdriver on the screw.

Another object of the present invention is to provide a screwdriver handle that can be used to tighten and loosen a screw, both without requiring the user to remove and reposition the screwdriver on the screw.

A further object of the present invention is to provide a screwdriver which is relatively inexpensive to manufacture, and which is durable.

SUMMARY OF THE INVENTION

The present invention is a handle intended to be used in conjunction with a conventional screwdriver that allows a user to operate on a screw without having to remove and reposition the screwdriver on the screw. The present invention comprises a shaft having an elongated cavity disposed therein, wherein the handle of a conventional screwdriver is accommodated within the cavity in a lengthwise orientation. A recoiling means attached to the end of the cavity is disposed lengthwise within the cavity with respect to the shaft, the recoiling means having a rubber stopper disposed at its end opposite of the end of the cavity.

The screwdriver is placed within the cavity of the shaft so that the rubber stopper contacts the top of the handle of the screwdriver. When a screw is to be operated on, the shaft of the present invention serves as the handle of the screwdriver so that the user may grasp the shaft and twist it to apply torque to the screw. The user must apply a downward normal force as well as a rotational force so that the recoiling means and the rubber stopper is compressed atop the handle of the screwdriver as the handle is rotated. This results in the transferring of the rotational force from the shaft of the present invention to the handle of the screwdriver. Because the handle of the screwdriver is connected to the shaft of the screwdriver, the rotational force applied to the handle ultimately operates the screw.

When the shaft is rotated to a point where the user is no longer able to apply adequate torque for its rotation, the user simply releases the downward normal force he had been applying to the screw and he rotates the shaft in an opposite direction to its original position. The recoiling means and rubber stopper apply sufficient force atop the handle of the screwdriver to prevent its tip from being disengaged from the recessed portion of the screw, but do not apply such a force as to impede the user from rotating the shaft to its original position.

BRIEF DESCRIPTION OF THE DRAWINGS

For a better understanding of the principle and nature of the present invention, reference should be made to the following detailed description taken in connection with the accompanying drawings in which.

DETAILED DESCRIPTION OF THE PREFERRED EMBODIMENT

Figure 1:
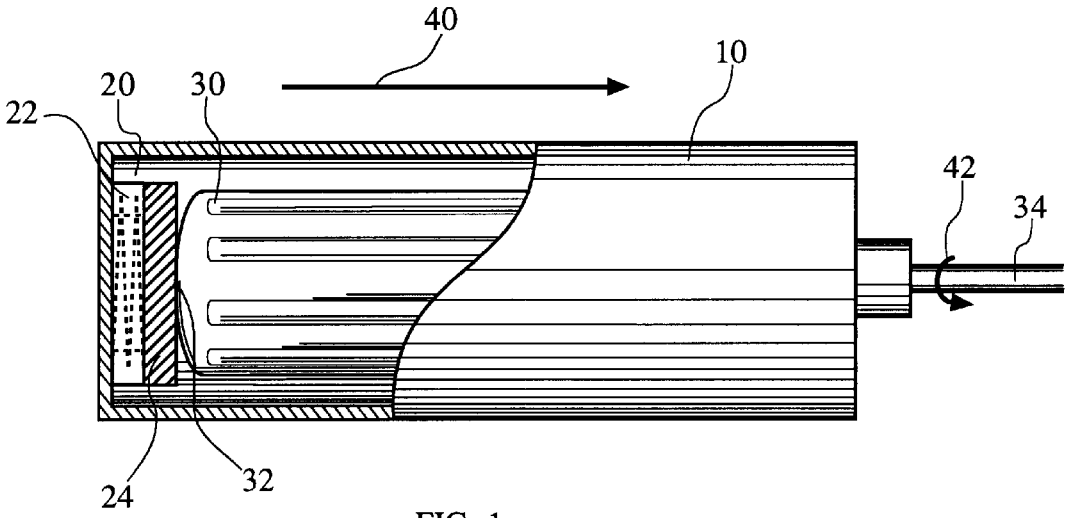
FIG. 1 a side cross-sectional view of the present invention when a downward normal force is applied to the shaft of the present invention.

Referring to FIG. 1, the present invention comprises a shaft 10 having an elongated cavity 20 disposed therein, wherein the handle of a conventional screwdriver 30 is accommodated within the cavity 20 in a lengthwise orientation. The cavity 20 has a first end 21 and a second end 27. A recoiling means 22 attached to the first end 21 of the cavity 20 is disposed lengthwise within the cavity 20 with respect to the shaft 10, the recoiling means 22 having a rubber stopper 24 attached to its other end. The recoiling means 22 comprises an inner concentric cylinder 22*a*, an outer concentric cylinder 22*b*, and a spring 22*c*. The inner concentric cylinder 22*a* longitudinally slides in and out of the outer concentric cylinder 22*b* when a downward normal force 40 is applied to the shaft 10 and released from the shaft 10, respectively. The inner concentric cylinder 22*a* and outer concentric cylinder 22*b* prevent the spring 22*c* from being bent out of shape when the shaft 10 is rotated. The inner concentric cylinder 22*a* and outer concentric cylinder 22*b* also integrally align the spring 22*c* and prevent it from compressing awkwardly.

The handle of a conventional screwdriver 30 is placed within the cavity 20 of the shaft 10 so that the rubber stopper 24 contacts the top of the handle 32 of the screwdriver 30. When a screw is to be operated on, the shaft 10 of the present invention serves as the handle of the screwdriver so that the user may grasp the shaft 10 and twist it to apply torque to the screw. The user must apply a downward normal force 40 with respect to the screw as well as a rotational force 42 so that the spring 22 and the rubber stopper 24 are compressed against the top of the handle 32 of the screwdriver as the handle is rotated. Engaging means 26 extend from the rubber stopper 24 towards the first end 21 of the cavity 20 that is connected to the spring 22. The engaging means 26 extends further laterally than the length of the compressed spring 22 so that when the user applies a downward normal force 40, the engaging means 26 contact the end of the cavity 20, thereby engaging with the first end 21 of the cavity either by force of friction between the engaging means 26 and the first end 21 of the cavity 20, or by forming a matable engagement with a recession at the first end 21 of the cavity 20. This results in the transferring of the rotational force 42 from the shaft 10 of the present invention to the handle of the screwdriver 30. Because the handle of the screwdriver is connected to the shaft of the screwdriver 34, the rotational force 42 applied to the shaft 10 ultimately operates the screw.

Figure 2:
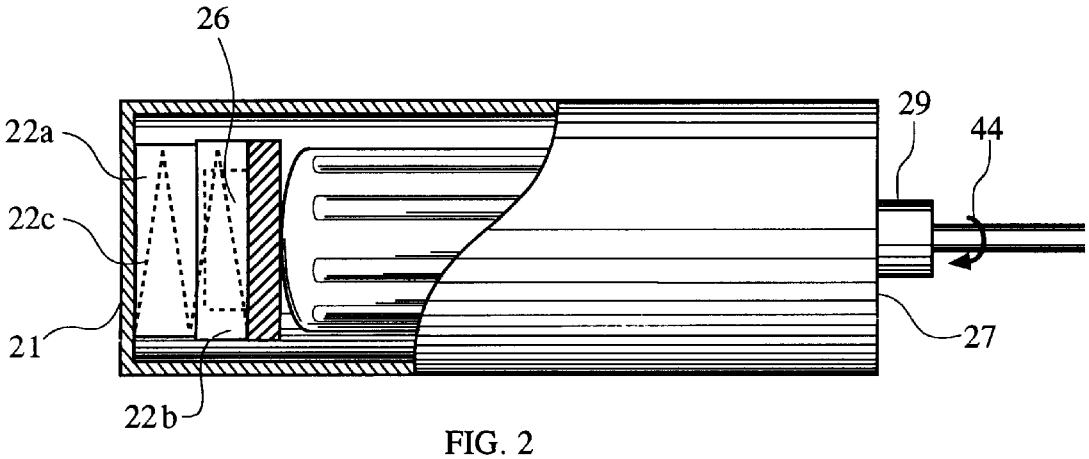
FIG. 2 is a side cross-sectional view of the present invention when a downward normal force is not applied to the shaft of the present invention.

Referring to FIG. 1 and FIG. 2, when the shaft 10 is rotated to a point where the user is no longer able to apply adequate torque for its rotation, the user simply releases the downward normal force 40 he had been applying to the screw and he rotates the shaft in an opposite direction 44 to its original position. The spring 22 and rubber stopper 24 apply sufficient force against the top of the screwdriver handle 32 to prevent the shaft of the screwdriver 34 from being disengaged from the recessed portion of the screw, but do not apply such a force as to impede the user from rotating the shaft 10 to its original position. In this manner, a user may reposition the screwdriver without removing the tip of the shaft of the screwdriver 34 from the screw.

The shaft 10 further has a supporting means 20 located at the second end 27 of the cavity 20. The supporting means 29 is used to maintain the handle and the shaft of the screwdriver in a parallel orientation with respect to the shaft of the screwdriver handle mechanism.

The shaft 10 has a means for allowing the user to insert the screwdriver handle 30 inside the cavity 20 of the shaft 10. In one embodiment, the screwdriver is placed inside the cavity 20 through a hatch on the shaft that swivels open and closed, wherein the hatch is fastened closed. In another embodiment, a lid disposed at the second end 27 of the shaft 10 allows the screwdriver to be inserted into the cavity 20 longitudinally, wherein the lid may be replaced, thereby fastening the screwdriver inside the shaft 10. These matters of design are not essential to the substance of this invention.

Because the shaft 10 is used as a handle, a shape of the shaft that is comfortable and that provides a sure grip should be used. In one embodiment, the cross-sectional shape of the shaft is circular. In another embodiment, the cross-sectional shape of the shaft is rectangular. In yet another embodiment, grooves intended to accommodate the fingers are disposed along the shaft 10. These matters of design are not essential to the substance of this invention.

What is claimed as being new and therefore desired to be protected by Letters Patent of the United States is as follows:

1. A screwdriver handle mechanism used in conjunction with a screwdriver comprising:

a) an elongated shaft;

b) said elongated shaft having an elongated cavity disposed therein;

1) said cavity having a first and second end;

(a) a recoiling member longitudinally disposed within said cavity attached to said first end of said cavity;

(b) a rubber stopper attached to said recoiling member;

(c) said second end of said cavity having a centrally disposed aperture;

2) wherein said elongated cavity accommodates a handle of said screwdriver, a shaft of said screwdriver fitting through said centrally disposed aperture of said second end of said cavity.

2. A screwdriver handle mechanism as mentioned in claim 1, wherein an engaging means extends from said rubber stopper towards said first end of said cavity, wherein when said recoiling member is compressed, said engaging means forms an engagement with said first end of said cavity.

3. A screwdriver handle mechanism as mentioned in claim 1, wherein a supporting means is used to maintain said handle and said shaft of said screwdriver in a parallel orientation with respect to said shaft of said screwdriver handle mechanism.

4. A screwdriver handle mechanism as mentioned in claim 1, wherein said recoiling member is a spring.

* * * * *